US006454066B1

(12) United States Patent
Chen

(10) Patent No.: US 6,454,066 B1
(45) Date of Patent: Sep. 24, 2002

(54) LUGGAGE

(76) Inventor: Shou Mao Chen, 344, Sec. 1, Chung San Rd. Tah-Cha Township, Taichung Hsien (TW)

( * ) Notice: Subject to any disclaimer, the term of this patent is extended or adjusted under 35 U.S.C. 154(b) by 0 days.

(21) Appl. No.: 09/870,556

(22) Filed: Jun. 1, 2001

(51) Int. Cl.[7] ..... A45C 13/00
(52) U.S. Cl. ..... 190/115; 190/18 A
(58) Field of Search ..... 190/18 R, 18 A, 190/115, 111; 780/37, 40, 655, 655.1; 16/113.1, 114.1

(56) References Cited

U.S. PATENT DOCUMENTS 5,692,266 A * 12/1997 Tsai ..... 16/113.1
5,926,914 A * 7/1999 Kuo ..... 16/405
5,984,154 A * 11/1999 Scicluna ..... 190/18 A
6,098,768 A * 8/2000 Tsai ..... 16/429
6,128,806 A * 10/2000 Shou-Mao ..... 16/113.1
6,223,392 B1 * 5/2001 Chang ..... 16/113.1
6,226,834 B1 * 5/2001 Lu ..... 16/113.1
6,247,203 B1 * 6/2001 Kuo ..... 16/113.1
6,289,554 B1 * 9/2001 Wang ..... 16/18 B
6,347,432 B1 * 2/2002 Kuo ..... 16/113.1
6,360,400 B1 * 3/2002 Chang ..... 16/113.1
6,367,602 B1 * 4/2002 Chang ..... 190/18 A

* cited by examiner

*Primary Examiner*—Lee Young
*Assistant Examiner*—Lien Ngo
(74) *Attorney, Agent, or Firm*—Harrison & Egbert

(57) ABSTRACT

A piece of luggage includes a shell, a handle, a pull rod set, and two slide wheel sets. The shell has a hollow interior which is divided by a partition into two compartments for containing articles. The pull rod set is disposed in the partition such that the retaining block of an action member of the pull rod set is detachably fastened to the handle. The pull rod set is activated by a press button such that the handle is forced to move upward to facilitate the moving of the luggage on a surface.

1 Claim, 7 Drawing Sheets

LUGGAGE

BACKGROUND OF THE INVENTION

1. Field of the Invention

The present invention relates generally to luggage, and more particularly to a pull rod set and a side wheel set for luggage.

2. Description of Related Art

Conventional luggage is generally provided with a pull rod set and a slide wheel set to facilitate the moving of the luggage on a surface with one hand of a user of the luggage. The pull rod set has an expandable pull rod and a pull rod control button for controlling the extraction of the pull rod. In the process of extracting the expandable pull rod, the user of the luggage must use one hand to press the control button, and the other hand to extract the expandable pull rod. In the event that the control button is inadvertently let go, the expandable pull rod cannot be extracted. Such an inconvenience as described above can be often a source of annoyance as far as the luggage user is concerned.

BRIEF SUMMARY OF THE INVENTION

It is the primary objective of the present invention is to provide a luggage pull rod set free of the deficiencies of the conventional luggage pull rod set described above.

It is another objective of the present invention to provide a luggage slide wheel set to cooperate with the luggage pull rod set to facilitate the moving of the luggage on a surface with one hand of a user of the luggage.

In keeping with the principle of the present invention, the foregoing objectives of the present invention are attained by a luggage comprising a shell, a pull rod set, and two slide wheel sets. The shell has a hollow interior which is divided by a partition into two compartments for holding articles. The pull rod set is disposed in the partition such that the pull rod set works in conjunction with a handle of the luggage. The luggage can be thus moved on a surface by a reason with his or her hand holding the handle of the luggage.

The features, functions, and advantages of the present invention will be more readily understood upon a thoughtful deliberation of the following detailed description of a preferred embodiment of the present invention with reference to the accompanying drawings.

DETAILED DESCRIPTION OF THE INVENTION

Figure 1:
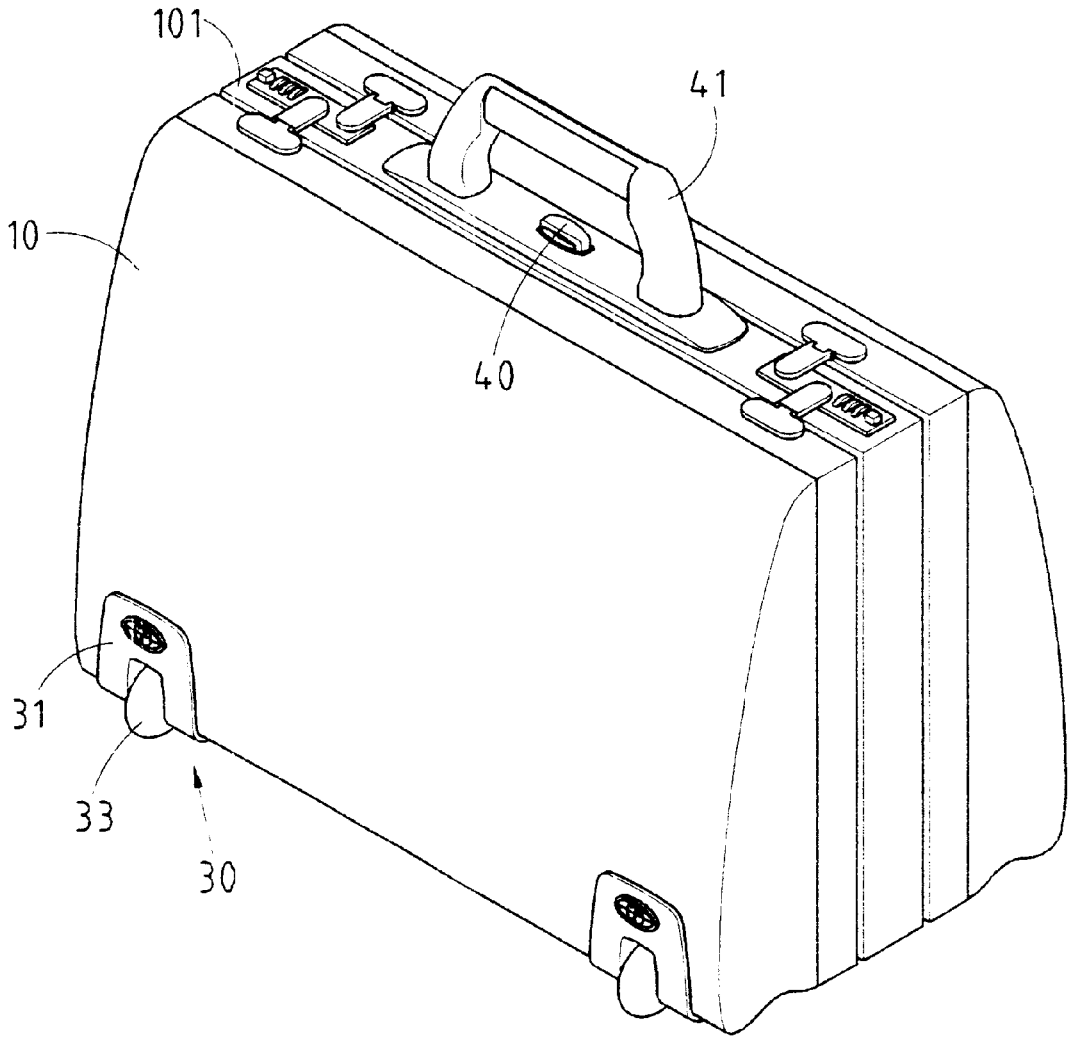
FIG. 1 shows an external perspective view of the preferred embodiment of the present invention.
Figure 2:
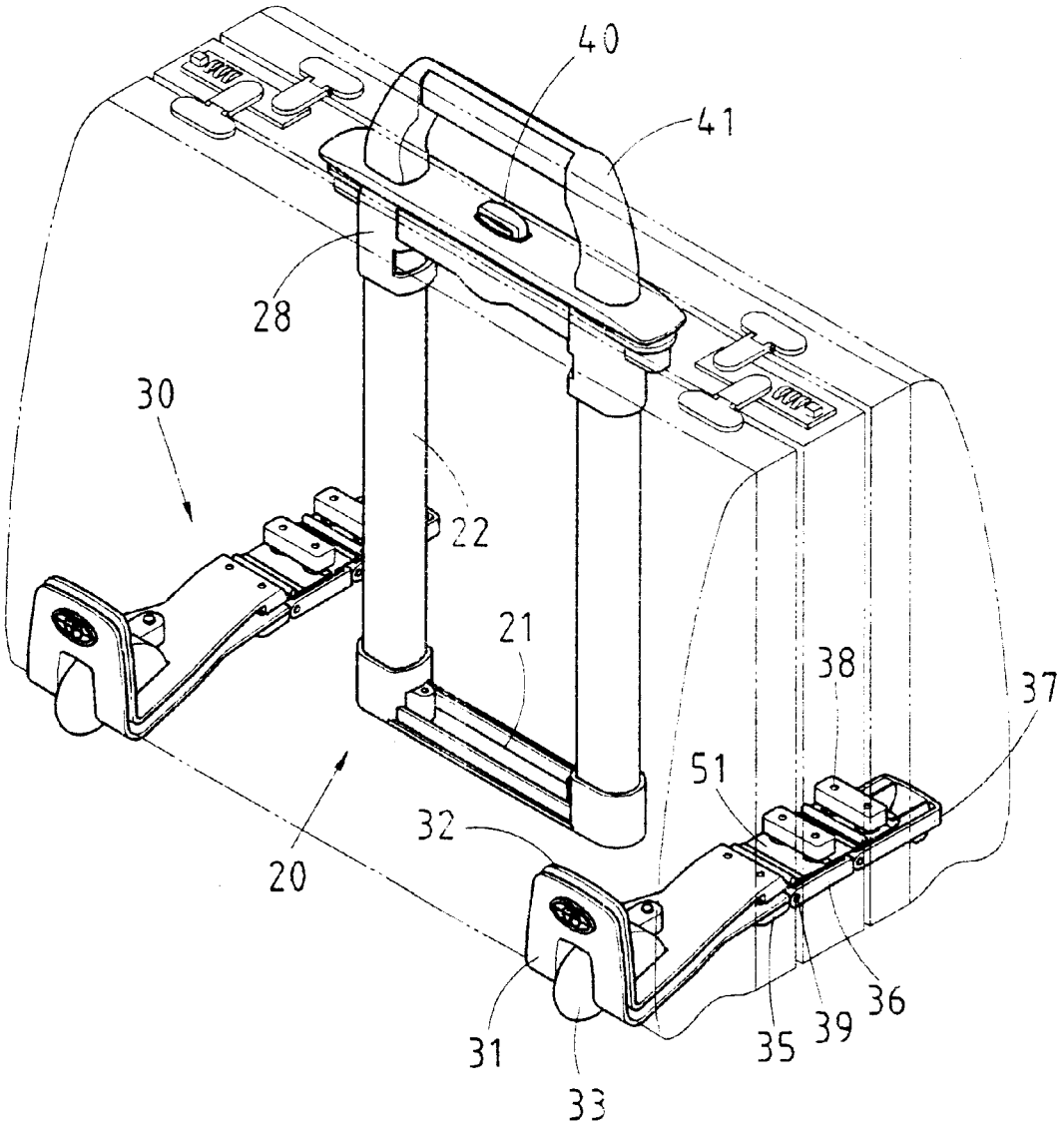
FIG. 2 shows an internal perspective view of the preferred embodiment of the present invention.
Figure 3:
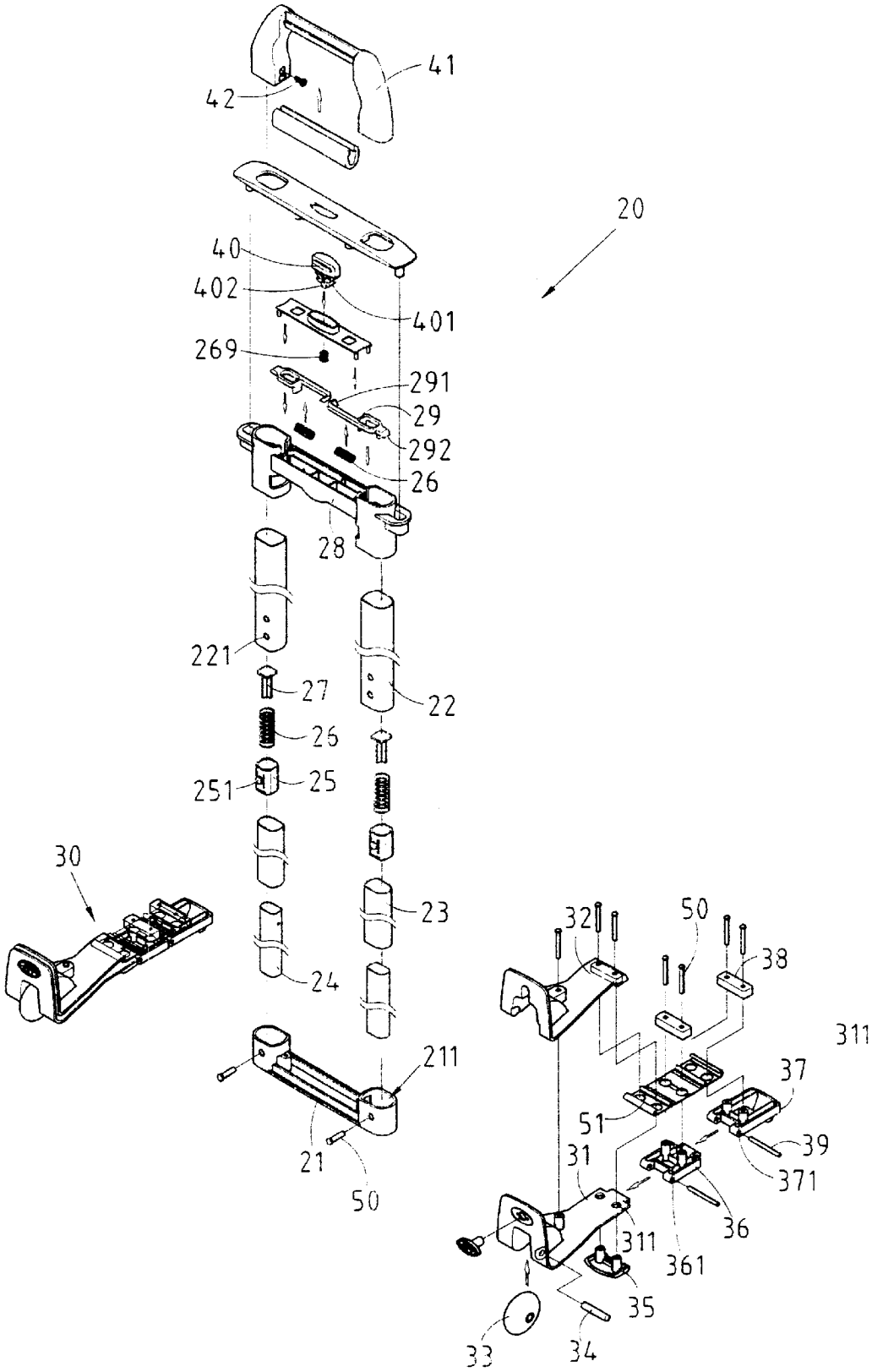
FIG. 3 shows an exploded view of the pull rod set and the slide wheel set of the preferred embodiment of the present invention.
Figure 4:
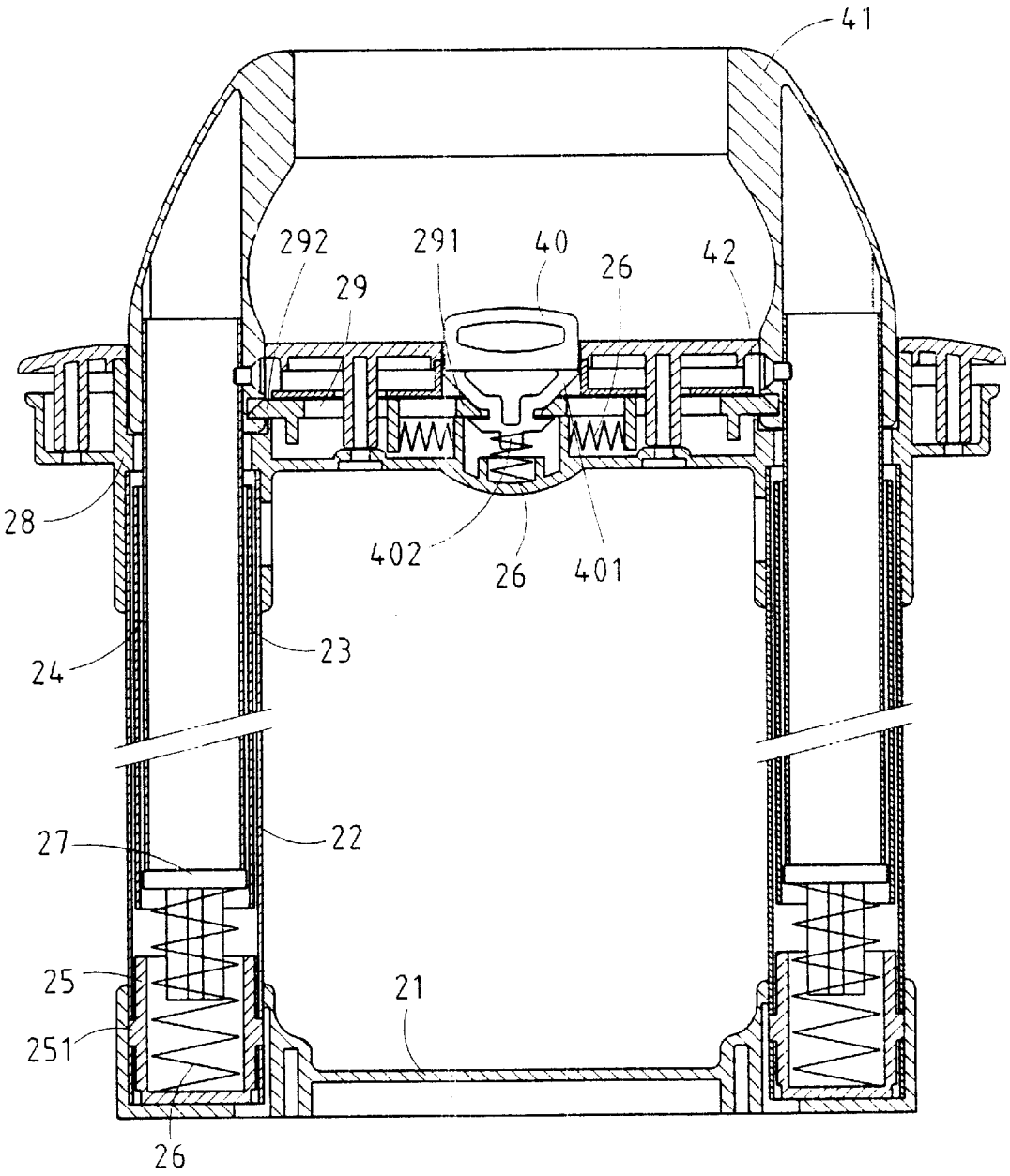
FIG. 4 shows a longitudinal sectional view of the pull rod set of the preferred embodiment of the present invention.
Figure 5:
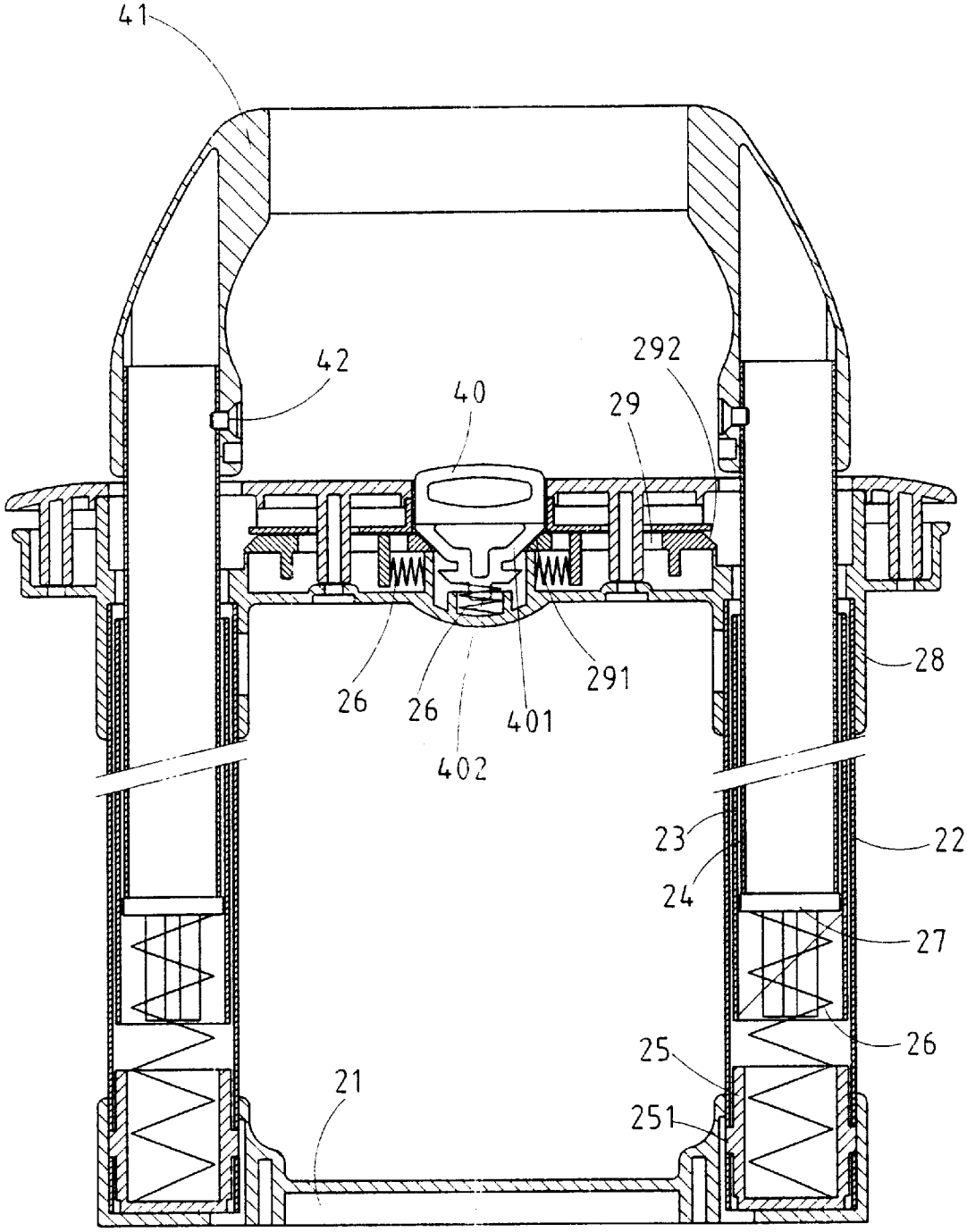
FIG. 5 shows another longitudinal sectional view of the pull rod set of the preferred embodiment of the present invention.
Figure 6:
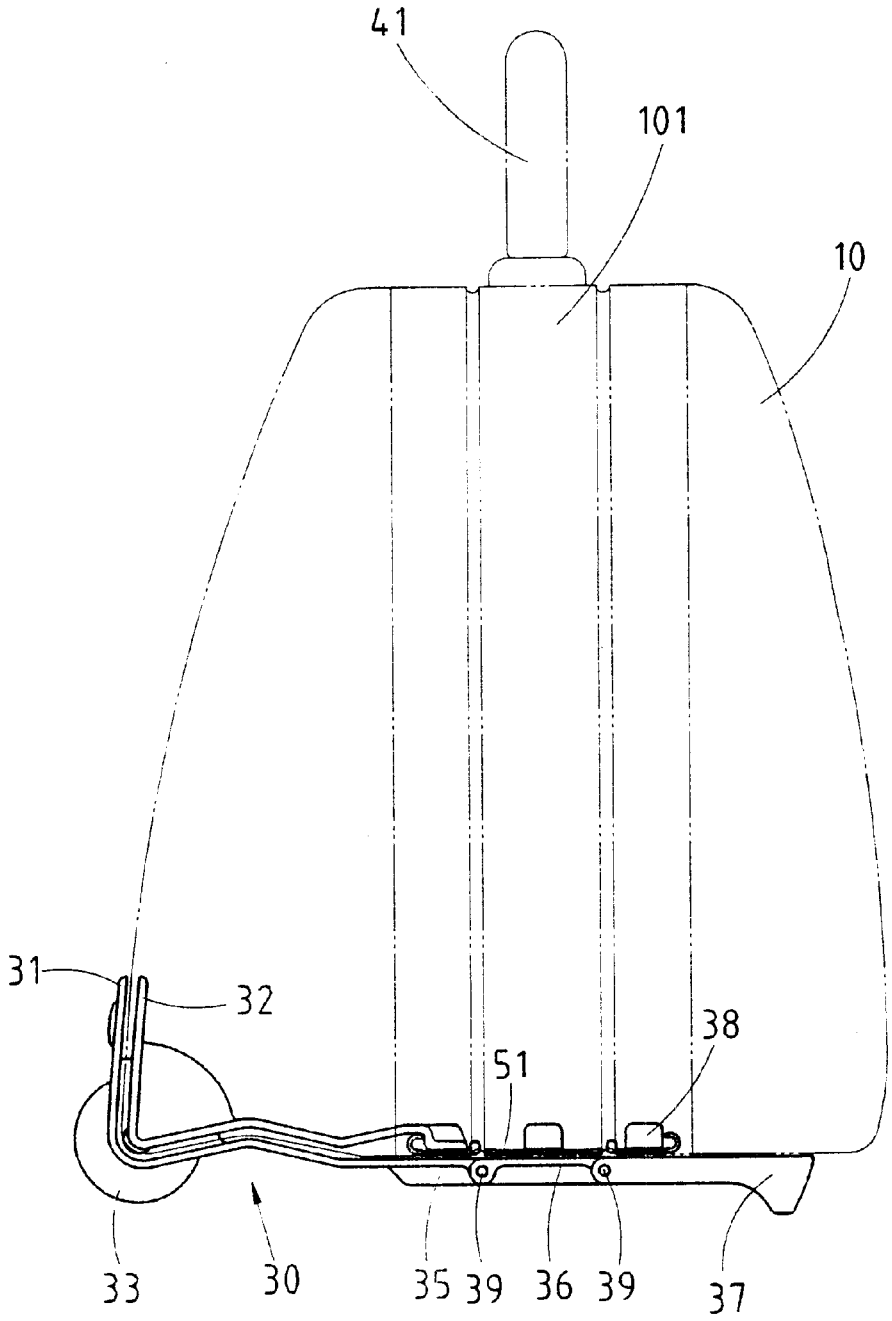
FIG. 6 shows a schematic view of the preferred embodiment of the present invention at work.
Figure 7:
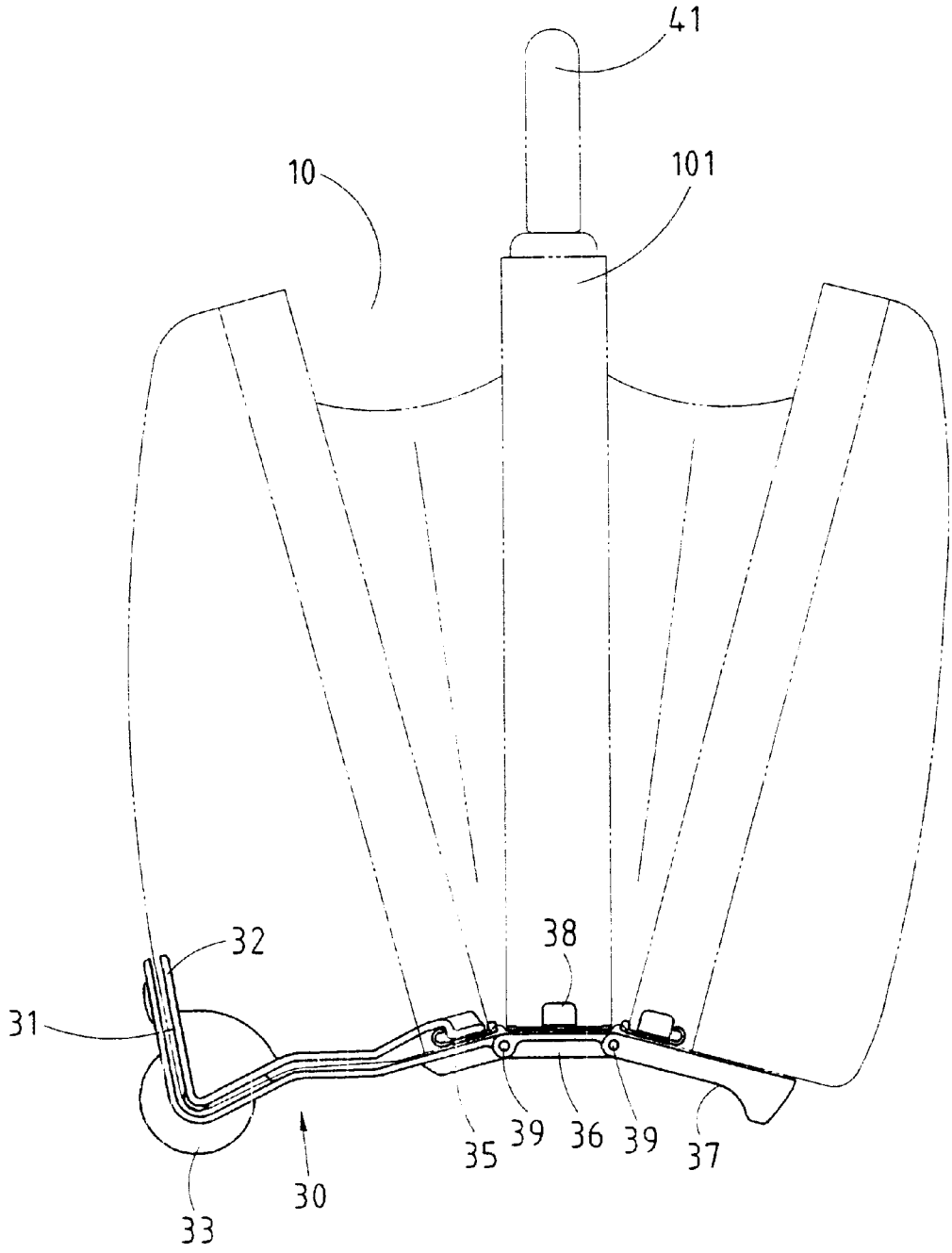
FIG. 7 shows another schematic view of the preferred embodiment of the present invention at work.

As shown in all drawings provided herewith, a luggage embodied in the present invention is formed of a shell 10, a pull rod set 20, and two slide wheel sets 30.

The shell 10 has a hollow interior which is divided into two compartments by a partition 101. The two compartments are intended to hold articles. The shell 10 is provided in the external side of the top thereof with a handle 41 fastened thereto.

The pull rod set 20 is disposed in the partition 101 of the interior of the shell 10 in conjunction with the handle 41. The pull rod set 20 comprises a base 21, which is fixed to the bottom of the partition 101 and is provided at both longitudinal ends with a retaining slot 211 for retaining a first rod member 22, a second rod member 23, a third rod member 24, a position-confining member 25, a resilient element 26, a pressing member 27, in conjunction with a disposition member 28. The first rod member 22 is provided with an insertion hole 221. The position confining member 25 is provided with an insertion block 251. The resilient element 26 and the pressing member 27 are disposed in the position confining member 25 which is secured in place in the first rod member 22 such that the insertion block 251 of the position confining member 25 is inserted into the insertion hole 221 of the first rod member 22. The pressing member 27 is in contact with the third rod member 24. An action member 29 is disposed in the disposition member 28 and is provided with a push face 291 and a retaining block 292. The push face 291 is in contact with a push block 401 of a press button 40. The retaining block 292 of the action member 29 is fastened with the handle 41 by a screw 42. The press button 40 is provided with a fitting block 402 and is disposed in the disposition member 28 in conjunction with an elastic element 269 which is fitted over the fitting block 402 of the press button 40.

The slide wheel sets 30 comprise an outer piece 31, a locating piece 32, a slide wheel 33, an axle 34, a holding member 35, two pivoting pieces 36 and 37, a cover 38, a pivot 39, a plurality of locating members 50, and a fixation member 51. The outer piece 31 is provided with a plurality of fastening holes 311. The slide wheel 33 is mounted on the axle 34. The pivoting piece 36 is provided with a pivoting hole 361 for pivoting the pivoting pieces 36, 37 with the outer piece 31 by the pivot 39 which is received in the pivoting hole 361. The slide wheel set 30 is located in the underside of the bottom of the shell 10 by the locating members 50 in conjunction with the fixation member 51.

As the press button 40 is pressed, the push block 401 of the press button 40 pushes the push face 291 of the action member 29, thereby forcing the action member 29 to put a pressure on the resilient element 26. In the meantime, the retaining block 292 of the action member 29 moves into the disposition member 28 so as to become separated from the handle 41. The third rod member 24 is acted on by the pressing member 27 and the resilient element 26 such that the third rod member 24 is forced to move upward, thereby actuating the handle 41 to move upward. It must be noted here that the first rod member 22, the second member 23, and the third rod member 24 of the pull rod set 20 are arranged in a telescopic manner.

I claim:

1. A luggage comprising:

a shell having a hollow interior and a partition which divides the hollow interior into two compartments for containing articles, said shell provided in the external side of a top thereof with a handle;

a pull rod set disposed in said partition of said shell in conjunction with said handle, said pull rod set comprising a base which is fixed to a bottom of said partition and is provided at both longitudinal ends with a retaining slot for retaining a first rod member, a second rod member, a third rod member, a position confining member, a resilient element, a pressing member, in conjunction with a disposition member, said first rod member, said second rod member and said third rod member being of a telescopic construction, said first rod member provided with an insertion hole, said position confining member provided with an insertion block, said resilient element and said pressing member being disposed in said position confining member which is held in place in said first rod member such that said insertion block of said position confining member is attained in said insertion hole of said first rod member, said pressing member being in contact with said third rod member, said disposition member provided with an action member which is provided with a push face and a retaining block, said push face being in contact with a push block of a press button, said retaining block of said action member being fastened with said handle, said press button provided with a fitting block and disposed in said disposition member in conjunction with an elastic element which is fitted over said fitting block of said press button; and two slide wheel sets fastened to the underside of a bottom of said shell such that said two slide wheel sets are opposite in location to each other, said two slide wheel sets comprising an outer piece, a locating piece, a slide wheel, an axle, a holding member, two pivoting pieces, a cover, a pivot, a plurality of locating members, and a fixation member, said outer piece provided with a plurality of fastening holes, said slide wheel being mounted on said axle, said pivoting piece provided with a pivoting hole for pivoting said pivoting pieces with said outer piece by said pivot which is received in said pivoting hole, said slide wheel sets being fastened to the underside of the bottom of said shell by said locating members in conjunction with said fixation member;

said push block of said press button pushing said push face of said action member at the time when said press button is exerted on by an external force, thereby forcing said action member to press against said resilient element such that said retaining block of said action member moved into said disposition member to become separated from said handle, and that said third rod member is acted on by said pressing member and said resilient member to move upward to actuate said handle to move upward.

* * * * *